US010662947B2

(12) United States Patent
Endo

(10) Patent No.: US 10,662,947 B2
(45) Date of Patent: May 26, 2020

(54) OIL-FLOODED SCREW COMPRESSOR SYSTEM AND METHOD FOR MODIFYING THE SAME

(71) Applicant: MAYEKAWA MFG. CO., LTD., Tokyo (JP)

(72) Inventor: Yasuaki Endo, Tokyo (JP)

(73) Assignee: MAYEKAWA MFG. CO., LTD., Tokyo (JP)

( * ) Notice: Subject to any disclaimer, the term of this patent is extended or adjusted under 35 U.S.C. 154(b) by 411 days.

(21) Appl. No.: 15/550,370

(22) PCT Filed: Feb. 12, 2015

(86) PCT No.: PCT/JP2015/053826
§ 371 (c)(1),
(2) Date: Aug. 11, 2017

(87) PCT Pub. No.: WO2016/129083
PCT Pub. Date: Aug. 18, 2016

(65) Prior Publication Data
US 2018/0023571 A1 Jan. 25, 2018

(51) Int. Cl.
*F04C 29/02* (2006.01)
*F04C 18/16* (2006.01)
(Continued)

(52) U.S. Cl.
CPC ..... *F04C 29/021* (2013.01); *F04C 18/16* (2013.01); *F04C 28/28* (2013.01); *F04C 29/02* (2013.01);
(Continued)

(58) Field of Classification Search
CPC ..... F04C 18/16; F04C 18/20; F04C 2210/22; F04C 2230/85; F04C 2240/30;
(Continued)

(56) References Cited

U.S. PATENT DOCUMENTS 4,394,113 A * 7/1983 Bammert ..... F04C 29/02 418/201.2
5,727,936 A * 3/1998 Eriksson ..... F04C 29/02 184/6.16
(Continued)

FOREIGN PATENT DOCUMENTS

CN 1496447 5/2004
EP 2896834 7/2015
(Continued)

OTHER PUBLICATIONS

"International Search Report (Form PCT/ISA/210)", dated May 19, 2015, with English translation thereof, pp. 1-4.
(Continued)

*Primary Examiner* — Patrick Hamo
*Assistant Examiner* — Paul W Thiede
(74) *Attorney, Agent, or Firm* — JCIPRNET

(57) ABSTRACT

An oil-flooded screw compressor system includes: a first lubricating oil supply system for supplying lubricating oil to screw parts; and a second lubricating oil supply system for supplying the lubricating oil to a bearing. The first lubricating oil supply system includes: a gas-liquid separator; a first supply flow passage; and a first supply path. The second lubricating oil supply system includes: a lubricating oil reservoir; a second supply flow passage; a second supply path; a first discharge flow passage; and a discharge path. It is possible to suppress dissolution of a gas to be compressed in lubricating oil and to suppress damage to a bearing due to deterioration of the performance of the lubricating oil, even in a case where the gas to be compressed is compatible with the lubricating oil.

10 Claims, 7 Drawing Sheets

(51) Int. Cl.
*F04C 28/28* (2006.01)
*F04C 18/20* (2006.01)

(52) U.S. Cl.
CPC ..... *F04C 29/026* (2013.01); *F04C 18/20* (2013.01); *F04C 2210/22* (2013.01); *F04C 2230/85* (2013.01); *F04C 2240/30* (2013.01); *F04C 2240/52* (2013.01); *F04C 2240/60* (2013.01); *F04C 2270/19* (2013.01)

(58) Field of Classification Search
CPC ..... F04C 2240/52; F04C 2240/60; F04C 2270/19; F04C 28/28; F04C 29/02; F04C 29/021; F04C 29/026; F04C 27/009
USPC ..... 418/98, 202
See application file for complete search history.

(56) References Cited

U.S. PATENT DOCUMENTS

| | | | | |
|---|---|---|---|---|
| 5,957,676 | A | 9/1999 | Peeters | |
| 6,149,408 | A | 11/2000 | Holt | |
| 9,568,001 | B2 * | 2/2017 | Endo | F04C 18/16 |
| 2005/0040356 | A1 * | 2/2005 | Uemura | F04B 27/1804 251/129.15 |
| 2008/0152524 | A1 * | 6/2008 | Kishi | F04C 18/16 418/1 |
| 2011/0059880 | A1 * | 3/2011 | Short | C10M 111/04 508/501 |
| 2015/0260187 | A1 | 9/2015 | Endo et al. | |

FOREIGN PATENT DOCUMENTS

| | | |
|---|---|---|
| GB | 2111662 | 7/1983 |
| JP | S56-88986 | 7/1981 |
| JP | S58-107888 | 6/1983 |
| JP | H01-257789 | 10/1989 |
| JP | H10-54384 | 2/1998 |
| WO | 2014041680 | 3/2014 |

OTHER PUBLICATIONS

The applicant's informal comments on the written opinion of the International Searching Authority (Form PCT/ISA/237) submitted Oct. 22, 2015, pp. 1-3.
"Office Action of Australia Counterpart Application," dated Jul. 6, 2018, p. 1-p. 3.
"Office Action of China Counterpart Application," dated Aug. 22, 2018, with English translation thereof, p. 1-p. 14.
"Search Report of Europe Counterpart Application" , dated Oct. 24, 2017, p. 1-p. 8, in which the listed reference was cited.
Office Action of India Counterpart Application, with English translation thereof, dated May 29, 2019, pp. 1-7.
"International Preliminary Report on Patentability (Form PCT/IB/373)", dated Aug. 15, 2017, with English translation thereof, pp. 1-12.

* cited by examiner

SECTION A (ENLARGED)

SECTION B (ENLARGED)

SECTION C
(ENLARGED)

OIL-FLOODED SCREW COMPRESSOR SYSTEM AND METHOD FOR MODIFYING THE SAME

CROSS-REFERENCE TO RELATED APPLICATION

This application is a 371 application of the international PCT application serial no. PCT/JP2015/053826, filed on Feb. 12, 2015. The entirety of each of the abovementioned patent applications is hereby incorporated by reference herein and made a part of this specification.

TECHNICAL FIELD

The present disclosure relates to an oil-flooded screw compressor system and a method for modifying the same.

BACKGROUND ART

A screw compressor includes: a pair of male and female screw rotors each including a screw part and shaft portions formed on both ends of the screw part; a housing having a screw chamber for accommodating the screw part and a bearing chamber for accommodating the shaft portions; and a bearing, disposed in the bearing chamber, for rotatably supporting the shaft portions.

For the oil-flooded screw compressor, lubricating oil is supplied to the bearing that rotatably supports the shaft portions and to screw lobe surfaces which engage with one another to form a compressor chamber.

In a typical oil-flooded screw compressor, a part of lubricating oil supplied to the bearing is fed to the screw chamber through a flow passage formed through a housing wall, and is discharged from the screw chamber with a compressed discharge gas. The discharge gas including the lubricating oil is separated from the lubricating oil, and the separated lubricating oil is reused as lubricating oil.

Patent Document 1 discloses an oil-flooded screw compressor system aimed at preventing erosion of a bearing by a gas to be compressed that gets mixed with lubricating oil and reaches the bearing, in a case where the gas to be compressed contains an erosive component. In this oil-flooded screw compressor system, lubricating oil is supplied to the screw chamber and to the bearing chamber through different supply systems, and a seal structure is provided, which prevents entry of a gas to be compressed containing an erosive component to the bearing chamber. Accordingly, erosion of the bearing by the erosive component is prevented.

CITATION LIST

Patent Literature

Patent Document 1: WO2014/041680A

SUMMARY

Problems to be Solved

For an oil-flooded screw compressor, it is necessary to prevent condensation of a gas to be compressed at the discharge side of the compressor to ensure fluidity of the gas to be compressed. Further, if the gas to be compressed is compatible with lubricating oil, it is necessary to restrict the amount of compressed gas that dissolves in the lubricating oil to suppress a decrease in the viscosity of the lubricating oil supplied to the bearing chamber and ensure the lubricating performance. If the bearing chamber is supplied with lubricating oil having a low viscosity, the lubricating oil cannot exert the intended lubricating performance, which may cause damage to the bearing portion.

To restrict condensation and the amount of dissolution of the gas to be compressed, one may consider increasing the temperature of the gas to be compressed at the discharge side of the compressor, by increasing the temperature of the lubricating oil supplied to the screw lobe surfaces or by reducing the amount of lubricating oil.

However, these approaches have limits in relation to the temperature limit of the bearing or due to the need to ensure the lubricating performance.

Alternatively, the gas to be compressed and the lubricating oil may be heated by a heater after discharge, for instance. However, the lubricating oil also has a function to cool the gas to be compressed, and is cooled by an oil cooler in advance. Heating the cooled lubricating oil with a heater may lead to generation of unnecessary energy loss.

Patent Document 1 does not disclose the above problem nor any solution to the above problem.

The present invention was made in view of the above problem. An object of the present invention is to restrict condensation and the amount of dissolution of gas to be compressed into lubricating oil to ensure the lubricating performance of the lubricating oil, even in a case where the gas to be compressed is compatible with the lubricating oil. Another object is to provide a method for producing the oil-flooded screw compressor system of the present invention by making a simple modification to a typical oil-flooded screw compressor.

Solution to the Problems (1) An oil-flooded screw compressor system for compressing a gas to be compressed which is a compatible gas with lubricating oil, according to at least one embodiment of the present invention, comprises: a screw compressor which includes: a male screw rotor and a female screw rotor each having a screw part and shaft portions formed on both ends of the screw part; a housing having a screw chamber accommodating the screw parts inside and a bearing chamber accommodating the shaft portions inside; and a bearing disposed in the bearing chamber, for rotatably supporting the shaft portions; a first lubricating oil supply system for supplying lubricating oil to the screw parts; and a second lubricating oil supply system for supplying the lubricating oil to the bearing. The first lubricating oil supply system includes: a gas-liquid separator configured to introduce discharge gas of the screw compressor therein and to separate the lubricating oil from the discharge gas; a first supply flow passage formed through a housing wall which constitutes the housing, the first supply flow passage having an opening on an outer surface of the housing wall and being in communication with the screw chamber; and a first supply path connected to a lubricating-oil storage region of the gas-liquid separator and to the opening of the first supply flow passage. The second lubricating oil supply system includes: a lubricating oil reservoir; a second supply flow passage formed through the housing wall, the second supply flow passage having an opening on the outer surface of the housing wall and being in communication with the bearing chamber; a second supply path connected to the lubricating oil reservoir and to the opening of the second supply flow passage; a first discharge flow passage formed through the housing wall, the first discharge flow passage being in communication with the bearing chamber and having an opening on the outer surface of the housing wall; and a discharge path connected to the lubricating oil reservoir and to the opening of the first discharge flow passage.

In the present specification, "lubricating oil" may include a substance which is normally called "lubricant", such as polyalkylene glycol (PAG).

In the above configuration (1), two supply systems are provided to form independent circulation systems: the first lubricating oil supply system for supplying lubricating oil to the screw chamber, and the second lubricating oil supply system for supplying lubricating oil to the bearing chamber.

Thus, lubricating oil supplied to the bearing is not supplied to the screw chamber, unlike the above described typical oil-flooded screw compressor. Accordingly, it is possible to reduce the amount of lubricating oil to be supplied to the screw chamber. Therefore, it is possible to suppress cooling of the gas to be compressed in the screw chamber and to increase the temperature of the gas to be compressed at the discharge side of the compressor, which makes it possible to suppress condensation and dissolution of the gas to be compressed in the lubricating oil.

Thus, it is possible to ensure the lubricating performance of the lubricating oil.

Furthermore, the lubricating oil supplied to the bearing chamber does not make contact with the gas to be compressed having a high discharge temperature, and thus it is possible to reduce the size of the oil cooler for cooling lubricating oil to be supplied to the bearing chamber.

Furthermore, in the compressor system of the present invention, minute leakage of lubricating oil is allowable between the screw chamber and the bearing chamber. Thus, a costly seal structure like the one in Patent Document 1 is not provided, and thereby it is possible to reduce the size and costs of the seal structure.

(2) In some embodiments, in the above configuration (1), a first branch discharge flow passage is formed so as to communicate with the first discharge flow passage and with the screw chamber, and the first branch discharge flow passage is closed by a first closure member.

The above described typical oil-flooded screw compressor has a flow passage for introducing lubricating oil discharged from the bearing chamber into the screw chamber, that is, the same flow passage as the first discharge flow passage and the first branch discharge flow passage.

With the above configuration (2), a typical oil-flooded screw compressor can be suitably modified into an oil-flooded screw compressor according to at least one embodiment of the present invention.

That is, a typical oil-flooded screw compressor can be modified into the oil-flooded screw compressor of the present invention by merely closing the first branch discharge flow passage of a typical compressor with the first closure member, and providing the first discharge flow passage.

(3) In some embodiments, in the above configuration (1) or (2), the lubricating oil reservoir is a sealed tank. The oil-flooded screw compressor system further comprises: a suction path connected to an inlet port of the screw compressor; a suction branch path branched from the suction path and connected to the lubricating oil reservoir; a return pipe connected to the lubricating oil reservoir and to a lubricating oil storage region of the gas-liquid separator; an open-close valve disposed in the return pipe; an oil-surface level sensor provided for the lubricating oil reservoir; and a controller which is configured to receive a detection value from the oil-surface level sensor and to open the open-close valve when the detection value is at most a threshold.

The suction-side bearing chamber has a higher pressure than the suction-side region of the screw chamber, and thus lubricating oil of the bearing chamber may slightly flow into the screw chamber. Thus, the amount of lubricating oil in the second lubricating oil supply system gradually decreases. It should be noted that the discharge-side region of the screw chamber and the discharge-side bearing chamber have substantially the same pressure, and thus lubricating oil leaks little therebetween.

With the above configuration (3), the suction path of the screw compressor has a lower pressure than the discharge path, and the lubricating oil reservoir communicating with the suction path via the suction branch path also has a low pressure. In contrast, the gas-liquid separator connected to the discharge path has a higher pressure than the lubricating oil reservoir. Thus, the lubricating oil inside the gas-liquid separator can be automatically recovered into the lubricating oil reservoir through the return pipe by opening the open-close valve disposed in the return pipe.

Accordingly, when the oil-surface level of the lubricating oil inside the lubricating oil reservoir decreases, it is possible to ensure the oil storage amount of the lubricating oil reservoir through automatic return of the lubricating oil from inside the gas-liquid separator to the lubricating oil reservoir.

While the lubricating oil stored in the gas-liquid separator contains gas to be compressed, the gas to be compressed is separated from the lubricating oil when the lubricating oil enters the lubricating oil reservoir having a low pressure, and is discharged through the inlet port of the screw compressor via the suction branch path and the suction path. Thus, lubricating oil stored in the lubricating oil reservoir contains a less amount of gas to be compressed.

(4) In some embodiments, in the above configuration (3), the oil-flooded screw compressor system further comprises: a discharge gas path disposed in the housing; a temperature sensor for detecting a temperature of the discharge gas flowing through the discharge gas path; and a flow-rate adjustment valve disposed in the first supply path. The controller is configured to receive a detection value of the temperature sensor and to adjust an opening degree of the flow-rate adjustment valve to adjust the temperature of the discharge gas.

With the above configuration (4), the temperature of the discharge gas can be adjusted to a desired temperature. Accordingly, it is possible to increase the temperature of the gas to be compressed, which makes it possible to suppress condensation and dissolution of the gas to be compressed in the lubricating oil.

(5) In some embodiments, in the above configuration (1), the gas to be compressed is a hydrocarbon gas.

In a petroleum refining process, for instance, a hydrocarbon gas is produced. A hydrocarbon gas has a condensable characteristic. When a screw compressor compresses a hydrocarbon gas, with any one of the above configurations (1) to (4), it is possible to suppress mixing between lubricating oil to be supplied to the bearing chamber and a hydrocarbon gas that is dissipated in the lubricating oil without being condensed. Accordingly, it is possible to suppress deterioration of the performance of the lubricating oil to be supplied to the bearing chamber, and to suppress damage to the bearing disposed in the bearing chamber.

(6) In some embodiments, in the above configuration (5), the gas to be compressed is a hydrocarbon gas having a molar mass of at least 44.

A hydrocarbon gas having a molar mass of at least 44 (e.g. a hydrocarbon gas having a molar mass greater than a propane gas) is especially likely to dissolve into a lubricating oil. Even for such a gas, with any one of the above configurations (1) to (3), it is possible to suppress mixing of the gas to be compressed with the lubricating oil to be supplied to the bearing chamber, and to suppress damage to the bearing disposed in the bearing chamber.

(7) A method of modifying an oil-flooded screw compressor system according to at least one embodiment of the present second invention is for an oil-flooded compressor system which comprises: a screw compressor which includes: a gas to be compressed which is compatible with lubricating oil; a male screw rotor and a female screw rotor each having a screw part and shaft portions formed on both ends of the screw part; a housing having a screw chamber accommodating the screw parts inside and a bearing chamber accommodating the shaft portions inside; and a bearing disposed in the bearing chamber, for rotatably supporting the shaft portions; a first lubricating oil supply system for supplying lubricating oil to the screw parts; and a second lubricating oil supply system for supplying the lubricating oil to the bearing. The first lubricating oil supply system includes: a gas-liquid separator configured to introduce discharge gas of the screw compressor therein and to separate the lubricating oil from the discharge gas; a first supply flow passage formed through a housing wall which constitutes the housing, the first supply flow passage having an opening on an outer surface of the housing wall and being in communication with the screw chamber; and a first supply path connected to a lubricating-oil storage region of the gas-liquid separator and to the opening of the first supply flow passage. The second lubricating oil supply system includes: a second supply flow passage formed through the housing wall, the second supply flow passage having an opening on the outer surface of the housing wall and being in communication with the bearing chamber; a second supply path connected to the opening of the second supply flow passage; and a second discharge flow passage formed through the housing wall and being in communication with the bearing chamber and the screw chamber. The method comprises: a first step of forming a third discharge flow passage through the housing wall, the third discharge flow passage being in communication with the second discharge flow passage and forming a linear through hole which has an opening on the outer surface of the housing wall and which opens into the screw chamber, together with the second discharge flow passage; a second step of connecting a discharge path to the opening of the third discharge flow passage on the outer surface of the housing wall; a third step of closing the opening of the second discharge flow passage on a side of the screw chamber with a first closure member; and a fourth step of connecting the discharge path to a lubricating oil reservoir connected to the second supply path.

According to the above method (7), the above first to fourth steps are performed on a typical oil-flooded screw compressor having the second discharge flow passage formed thereon, and thereby it is possible to modify a typical oil-flooded screw compressor into the oil-flooded screw compressor system of the present invention at low cost, in which the first lubricating oil supply system for supplying lubricating oil to the screw chamber and the second lubricating oil supply system for supplying lubricating oil to the bearing are separate and independent from each other.

(8) A method of modifying an oil-flooded screw compressor system, according to at least one embodiment of the present invention, is for an oil-flooded screw compressor system for compressing a gas to be compressed which is compatible with lubricating oil and which comprises: a screw compressor, the oil-flooded screw compressor system comprising: a male screw rotor and a female screw rotor each having a screw part and shaft portions formed on both ends of the screw part; a housing having a screw chamber accommodating the screw parts inside and a bearing chamber accommodating the shaft portions inside; and a bearing disposed in the bearing chamber, for rotatably supporting the shaft portions; a first lubricating oil supply system for supplying lubricating oil to the screw parts; and a second lubricating oil supply system for supplying the lubricating oil to the bearing. The first lubricating oil supply system includes: a gas-liquid separator configured to introduce discharge gas of the screw compressor therein and to separate the lubricating oil from the discharge gas; a first supply flow passage formed through a housing wall which constitutes the housing, the first supply flow passage having an opening on an outer surface of the housing wall and being in communication with the screw chamber; and a first supply path connected to a lubricating-oil storage region of the gas-liquid separator and to the opening of the first supply flow passage. The second lubricating oil supply system includes: a second supply flow passage formed through the housing wall, the second supply flow passage having an opening on the outer surface of the housing wall and being in communication with the bearing chamber; a second supply path connected to the opening of the second supply flow passage; and a third discharge flow passage formed through the housing wall and being in communication with the second discharge flow passage, the third discharge flow passage forming a linear through hole which has an opening on the outer surface of the housing wall and into the screw chamber together with the second discharge flow passage. The opening of the third discharge flow passage on the outer surface of the housing wall is closed by a second closure member. The method comprises: a fifth step of removing the second closure member and connecting a discharge path to the opening of the third discharge passage on the outer surface of the housing wall; a sixth step of closing the opening of the second discharge flow passage on the side of the screw chamber with a first closure member; and a seventh step of connecting the discharge path to a lubricating oil reservoir connected to the second supply path.

To form the second discharge flow passage for supplying lubricating oil discharged from the bearing chamber to the screw chamber by grinding on a typical oil-flooded screw compressor, it is necessary to form a linear through hole that penetrates the housing wall from the outer surface of the housing wall to the screw chamber. Thus, the third discharge flow passage is formed.

According to the above method (8), the above fifth to seventh steps are performed on a typical oil-flooded screw compressor having a through hole including the second discharge flow passage and the third discharge flow passage formed thereon, and thereby it is possible to modify a typical oil-flooded screw compressor into the oil-flooded screw compressor system of the present invention at low cost.

(9) In some embodiments, in the above method (7) or (8), the lubricating oil reservoir is a tank inside of which is sealable. The method further comprises: an eighth step of providing a suction branch path which branches from a suction path connected to an inlet port of the screw compressor and which connects to the lubricating oil reservoir; a ninth step of providing a return pipe to be connected to the lubricating oil reservoir and to a lubricating-oil storage region of the gas-liquid separator, and providing an open-close valve for the return pipe; and a tenth step of providing an oil-surface level sensor disposed in the lubricating oil reservoir, and a controller for receiving a detection value of the oil-surface level sensor and opening the open-close valve when the detection value becomes at most a threshold.

According to the above method (9), when the oil-surface level of lubricating oil inside the lubricating oil reservoir decreases, it is possible to return the lubricating oil inside the gas-liquid separator automatically to the lubricating oil reservoir by opening the open-close valve, due to the pressure difference between the lubricating oil reservoir and the gas-liquid separator. Accordingly, it is possible to ensure the amount of lubricating oil in the lubricating oil reservoir constantly.

Further, as described above, the gas to be compressed mixed into the lubricating oil stored in the lubricating oil reservoir having a low pressure is separated and discharged to an inlet port of the screw compressor via the suction branch path and the suction path, and thereby lubricating oil containing a great amount of gas to be compressed is not supplied to the bearing chamber.

Advantageous Effects

According to at least one embodiment of the present invention, it is possible to suppress dissolution of a gas to be compressed in lubricating oil and to suppress damage to a bearing due to deterioration of the performance of the lubricating oil, even in a case where the gas to be compressed is compatible with the lubricating oil. Furthermore, it is possible to produce the oil-flooded screw compressor system according to the present invention having the above effect by making a simple modification to a typical oil-flooded screw compressor system.

DETAILED DESCRIPTION

With reference the accompanied drawings, some embodiments of the present embodiments will be described. It is intended, however, that unless particularly specified, dimensions, materials, shapes, relative positions and the like of components described in the embodiments shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

FIGS. 1 to 4 are diagrams of an oil-flooded screw compressor system 10 according to at least one embodiment of the present invention.

Figure 1:
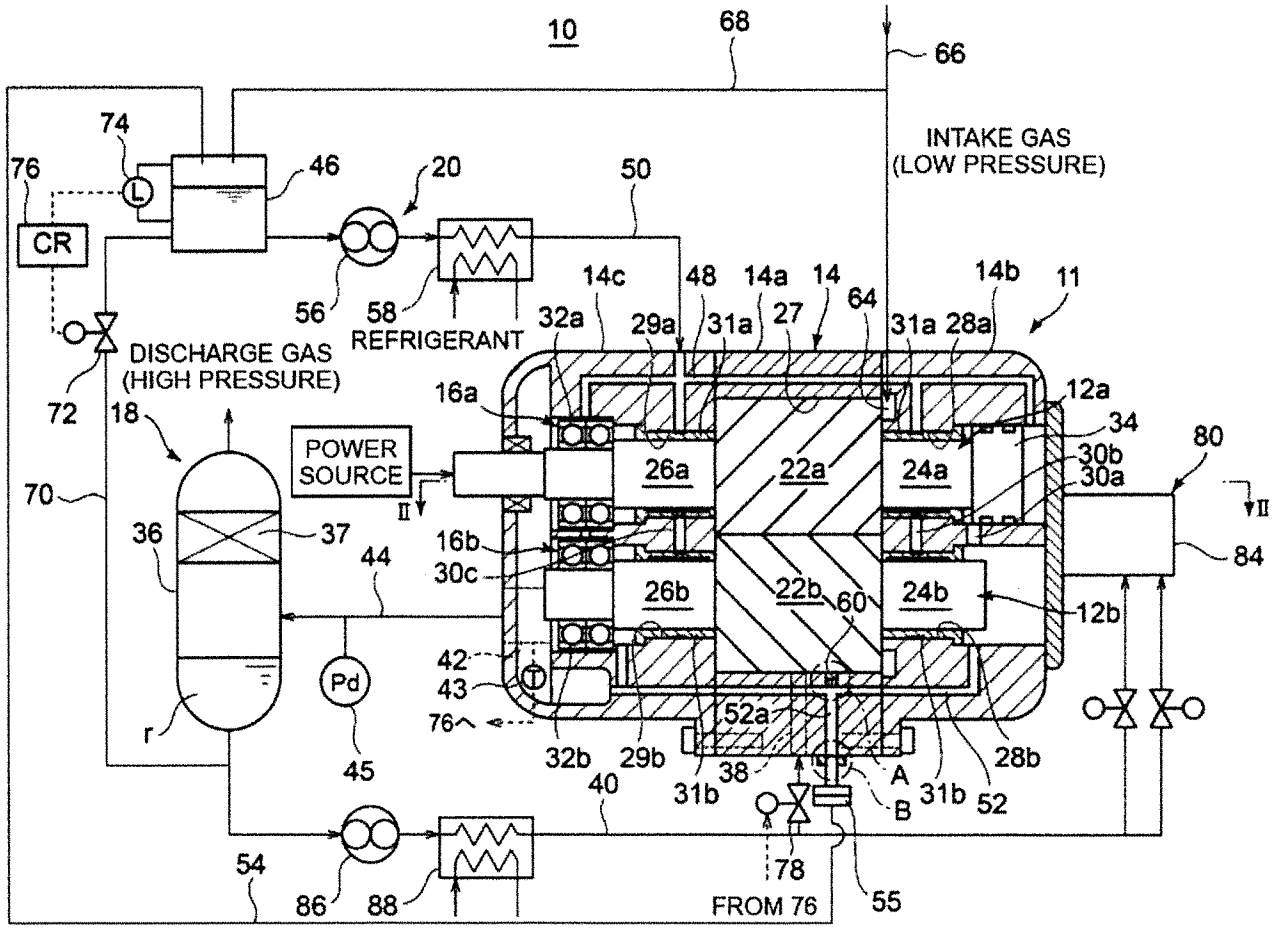
FIG. 1 is a system diagram of an oil-flooded screw compressor system according to an embodiment.

In FIG. 1, the oil-flooded screw compressor system 10 includes a pair of male and female screw rotors 12*a* and 12*b*, a housing 14 housing the screw rotors 12*a* and 12*b*, a screw compressor 11 including shaft portions 16*a* and 16*b* for rotatably supporting the screw rotors 12*a* and 12*b*, and a first lubricating oil supply system 18 and a second lubricating oil supply system 20 for supplying lubricating oil inside the housing 14.

The male and female screw rotors 12*a* and 12*b* respectively include screw parts 22*a* and 22*b*, and suction-side shaft portions 24*a*, 24*b* and discharge-side shaft portions 26*a*, 26*b* formed on both ends of the screw parts 22*a*, 22*b*. The screw parts 22*a* and 22*b* have screw lobe surfaces formed thereon, engaging with each other to form a plurality of compression chambers in the axial direction.

The housing 14 includes three casings: a screw casing 14*a* forming a screw chamber 27 that houses the screw parts 22*a* and 22*b* inside; a suction-side bearing casing 14*b* forming suction-side bearing chambers 28*a* and 28*b* that house the suction-side shaft portions 24*a* and 24*b* inside; and a discharge-side bearing casing 14*c* forming discharge-side bearing chambers 29*a* and 29*b* that house the discharge-side shaft portions 26*a* and 26*b* inside.

As an exemplary configuration, the screw casing 14*a*, the suction-side bearing casing 14*b*, and the discharge-side bearing casing 14*c* are coupled to each other by bolts in series so as to be separatable.

The bearing portions 16*a* and 16*b* have a radial bearing and a thrust bearing.

In an exemplary configuration, journal bearings 31*a* and 31*b* are disposed around the suction-side shaft portions 24*a*, 24*b* and the discharge-side shaft portions 26*a*, 26*b*, as radial bearings. Further, for instance, angular contact ball bearings 32*a* and 32*b* are disposed in the discharge-side bearing chambers 29*a* and 29*b*, as thrust bearings. The angular contact ball bearing 32*a* is fit and fixed to the discharge-side shaft portion 26*a* of the male screw rotor 12*a*, while the angular contact ball bearing 32*b* is fit and fixed to the discharge-side shaft portion 26*b* of the female screw rotor 12*b*. The angular contact ball bearings 32*a* and 32*b* receive axial thrust loads (compression reaction forces) that occur from compression of the gas to be compressed in the compression chambers.

Journal bearings 31*a* and 31*b* are provided to seal the gaps between the screw chamber 27 and the suction-side bearing chambers 28*a*, 28*b* or the discharge-side bearing chambers 29*a*, 29*b*.

To reduce the axial thrust loads that act on the thrust bearings, a piston (balance piston) 34 is mounted to the suction-side shaft portion 24*a* of the male screw rotor 12*a*. A part of the suction-side bearing chamber 28*a* is defined as a cylinder (balance cylinder), and the balance piston 34 is housed inside the balance cylinder so as to be slidable in the axial direction of the male screw rotor 12*a*. The axial thrust loads are reduced by operating the balance piston 34 to adjust the pressure inside the balance cylinder.

The first lubricating oil supply system 18 supplies lubricating oil to the screw parts 22*a* and 22*b*, and the second lubricating oil supply system 20 supplies lubricating oil to the bearing portions 16*a* and 16*b*.

The first lubricating oil supply system 18 includes a gas-liquid separator 36, a first supply flow passage 38 formed through a wall of the housing 14, and a first supply path 40 connected to the gas-liquid separator 36 and the first supply flow passage 38.

Discharge gas discharged from a discharge path 42 formed in the housing 14 is fed to the gas-liquid separator 36 via a discharge gas path 44. The discharge gas is separated from the lubricating oil when passing through a filter 37 inside the gas-liquid separator 36. The lubricating oil r separated from the discharge gas is accumulated in a lower section of the gas-liquid separator 36.

The first supply flow passage 38 is formed through a housing wall of the screw casing 14*a* and has an opening on the outer surface of the housing wall, thus communicating with the screw chamber 27. In some embodiments, the first supply flow passage 38 may be formed on a capacity control valve 82 described below, via the housing wall. The first supply path 40 is connected to the opening of the first supply flow passage 38 and to the lower section of the gas-liquid separator 36 in which the lubricating oil is accumulated.

The second lubricating oil supply system 20 includes a lubricating oil reservoir 46, a second supply flow passage 48 formed through a housing wall, a second supply path 50 connecting the lubricating oil reservoir 46 and the second supply flow passage 48, a first discharge flow passage 52 formed through the housing wall, a discharge path 54 connecting the lubricating oil reservoir 46 and the first discharge flow passage 52, and an oil pump 56 and an oil cooler 58 disposed in the second supply path 50.

The second supply flow passage 48 is formed through housing walls of the screw casing 14*a*, the suction-side bearing casing 14*b*, and the discharge-side bearing casing 14*c*, and has an opening part having an opening on the outer surface of the housing wall of the discharge-side bearing casing 14*c*. Further, the second supply flow passage 48 branches to the suction-side bearing chamber 28*a* and to the discharge-side bearing chamber 29*a* to be in communication with the bearing chambers.

The second supply path 50 is connected to the opening part of the second supply flow passage 48, and supplies lubricating oil stored in the lubricating oil reservoir 46 to the suction-side bearing chamber 28*a* and the discharge-side bearing chamber 29*a*. The suction-side bearing chamber 28*a* and the discharge-side bearing chamber 29*a* are in communication with the suction-side bearing chamber 28*b* and the discharge-side bearing chamber 29*b* via communication holes 30*a*, 30*b*, and 30*c*. The lubricating oil supplied to the suction-side bearing chamber 28*a* and the discharge-side bearing chamber 29*a* is supplied to the suction-side bearing chamber 28*b* and the discharge-side bearing chamber 29*b* via the communication holes 30*a*, 30*b*, and 30*c*.

Accordingly, lubricating oil is supplied to the angular contact ball bearings 32*a*, 32*b*, the journal bearings 31*a*, 31*b*, and the balance cylinder, which are disposed in the suction-side bearing chambers 28*a*, 28*b* and the discharge-side bearing chambers 29*a*, 29*b*.

The first discharge flow passage 52 is in communication with the suction-side bearing chamber 28*b* and the discharge-side bearing chamber 29*b* on the side of the female screw rotor 12*b*, and has an opening on the outer surface of the housing wall of the screw casing 14*a*. The discharge path 54 is connected to the opening of the first discharge flow passage 52 and to the lubricating oil reservoir 46.

Further, a first branch discharge flow passage 60 (second discharge flow passage) is formed to communicate with the first discharge flow passage 52 and the screw chamber 27.

Figure 3:
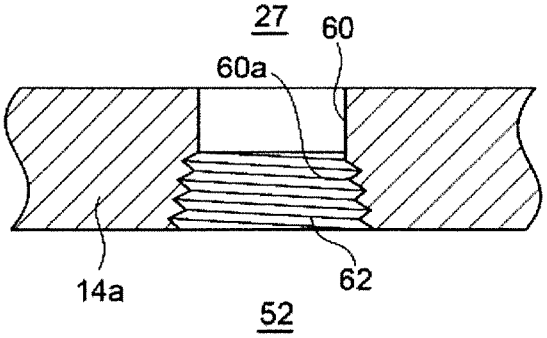
FIG. 3 is an enlarged cross-sectional view of section A in FIG. 1.

As shown in FIG. 3, the first branch discharge flow passage 60 has a tapered female threaded hole 60*a* formed on a side of the opening into the first discharge flow passage 52. A closure plug 62 having a tapered male thread formed thereon is engaged with the female threaded hole 60*a* to close the first branch discharge flow passage 60. A flow passage 52*a* constituting a part of the first discharge flow passage 52 has an opening on the outer surface of the housing wall, and also constitutes a linear though hole (third discharge flow passage) in the axial direction with the first branch discharge flow passage 60.

In an exemplary configuration of the present embodiment, the lubricating oil reservoir 46 is a closed tank with a closed space formed therein. Further, a suction path 66 is connected to an inlet port 64 of the screw compressor 11, and a suction branch path 68 branched from the suction path 66 is connected to the lubricating oil reservoir 46.

Further, a return pipe 70 is connected to the lubricating oil reservoir 46 and to the lubricating oil storage region of the gas-liquid separator 36. An open-close valve 72 is disposed in the return pipe 70. Further, the lubricating oil reservoir 46 includes an oil-surface level sensor 74 for detecting a liquid level of lubricating oil, and a controller 76 that receives a detection value from the oil-surface level sensor 74 and opens the open-close valve 72 when the detection value becomes at most a threshold.

A discharge pressure sensor 45 for detecting a pressure of discharge gas is disposed in the discharge gas path 44, and detection values of the discharge pressure sensor 45 are input into the controller 76.

The pressure inside the lubricating oil reservoir 46 communicating with the suction branch path 68 is as low as that in the suction path 66. On the other hand, the pressure inside the gas-liquid separator 36 communicating with the discharge path 42 is as high as the discharge path 42. Thus, when the open-close valve 72 is opened, the lubricating oil inside the gas-liquid separator 36 automatically flows into the lubricating oil reservoir 46. Accordingly, it is possible to ensure the amount of lubricating oil in the lubricating oil reservoir 46.

Furthermore, in an exemplary configuration, a temperature sensor 43 for detecting a temperature of discharge gas passing through the discharge path 42 is provided, and a flow-rate adjustment valve 78 is disposed in the first supply path 40. The controller 76 receives detection values from the temperature sensor 43 and is capable of adjusting the temperature of the discharge gas by adjusting the opening degree of the flow-rate adjustment valve 78.

Figure 2:
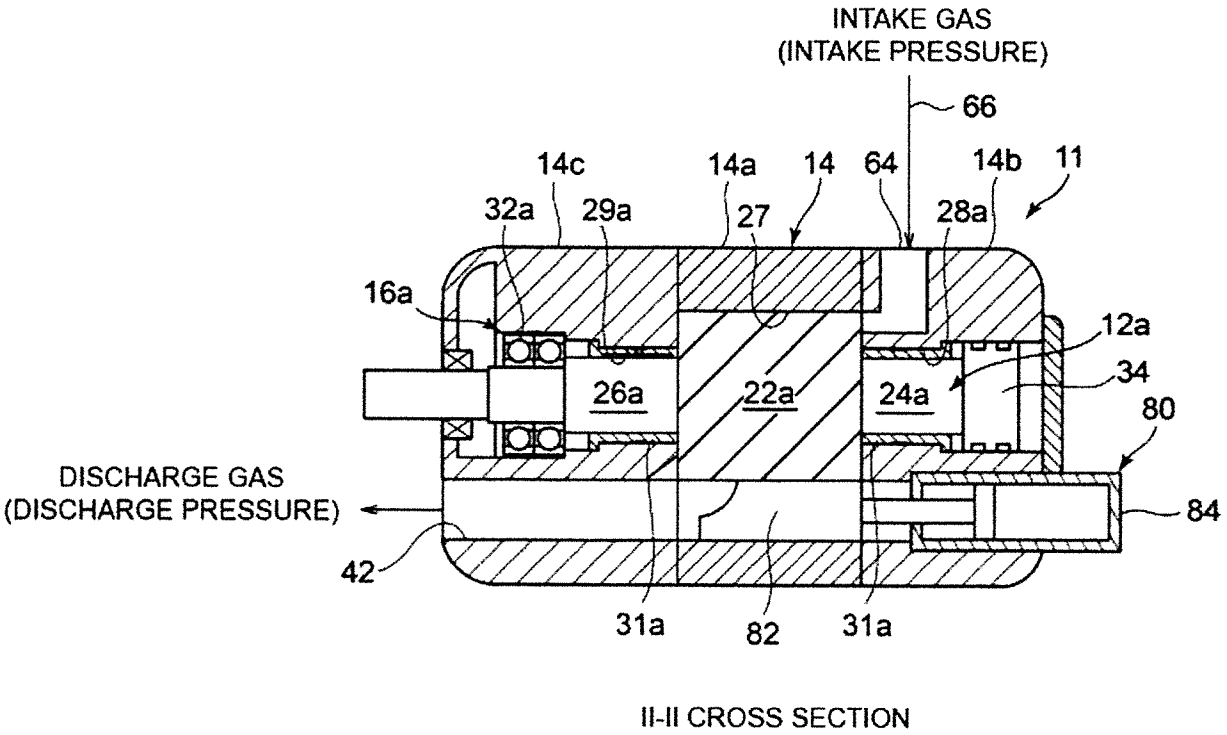
FIG. 2 is a front cross-sectional view taken along line II-II in FIG. 1.

Further, in an exemplary configuration, as shown in FIG. 2, a capacity control device 80 is provided. The capacity control device 80 includes the capacity control valve 82, which is housed in a cylinder (capacity control cylinder) defined inside the housing 14. The capacity control cylinder extends along the screw chamber 27 and is in communication with the discharge path 42. An end portion of the capacity control cylinder on the side of the discharge path 42 constitutes a radial communication part that is in communication with the compression chambers in the radial direction. Accordingly, the gas compressed in the compression chambers can flow into the discharge path 42 through the radial communication part of the discharge port and the radial communication part of the capacity control cylinder.

The capacity control valve 82 is disposed slidably in the axial direction of the male screw rotor 12*a* and the female screw rotor 12*b*. The capacity control valve 82 is coupled to the hydraulic cylinder 84 that serves as a drive unit. The first supply path 40 is connected to the hydraulic cylinder 84, and working oil is supplied to the hydraulic cylinder 84 from the first supply path 40. The capacity control valve 82 is caused to reciprocate inside the capacity control cylinder by the hydraulic cylinder 84.

The capacity control device 80 operates the hydraulic cylinder 84 to adjust the position of the capacity control valve 82, and thereby it is possible to adjust the length of the compression chambers in the axial direction, which is, in other words, the starting time of compression in the compression chambers, and to adjust the capacity of the screw compressor 11.

Figure 4:
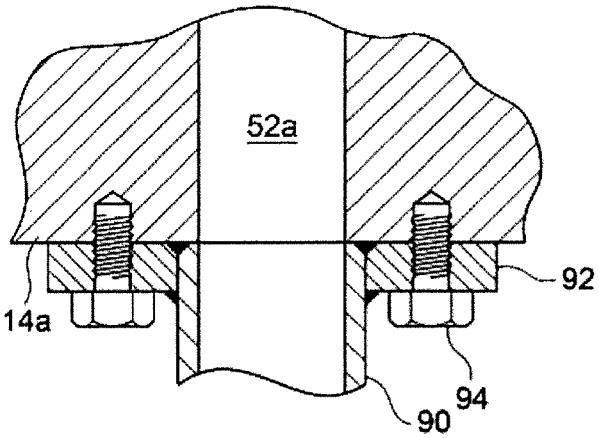
FIG. 4 is an enlarged cross-sectional view of section B in FIG. 1.

As shown in FIGS. 1 and 4, the connection part between the discharge path 54 and the screw casing 14*a* includes a coupling 55 and a pipe 90 connected to the coupling 55. A flange 92 is fixed to an end of the pipe 90, and is connected to the screw casing 14*a* with a plurality of bolts 94. Accordingly, the discharge path 54 is in communication with the first discharge flow passage 52.

Further, the first supply path 40 includes an oil pump 86 and an oil cooler 88 for feeding lubricating oil r that accumulates in the lower section of the gas-liquid separator 36 to the first supply flow passage 38.

With the above configuration, the discharge-side shaft portion 26*a* of the male screw rotor 12*a* is rotated by a power source (e.g. electric motor), and the female screw rotor 12*b* rotates in synchronization by engagement between the screw parts 22*a* and 22*b*.

In the first lubricating oil supply system 18, the lubricating oil r accumulated in the lower section of the gas-liquid separator 36 is cooled by the oil cooler 88, and is supplied to the screw chamber 27 via the first supply path 40 and the first supply flow passage 38. The lubricating oil lubricates the screw parts 22*a* and 22*b* in the screw chamber 27, and returns with the discharge gas to the gas-liquid separator 36 through the discharge path 42 and the discharge gas path 44.

In the second lubricating oil supply system 20, the lubricating oil inside the lubricating oil reservoir 46 is fed to the second supply path 50 by the oil pump 56 to be cooled by the oil cooler 58, and is supplied to the bearing portions 16*a* and 16*b* through the second supply flow passage 48. The lubricating oil after lubricating the bearing portions 16*a* and 16*b* flows through the first discharge flow passage 52 and the discharge path 54 and returns to the lubricating oil reservoir 46.

According to the above embodiment, the first lubricating oil supply system 18 and the second lubricating oil supply system 20 form independent circulation systems from each other, and thus lubricating oil supplied from the second lubricating oil supply system 20 to the bearing chamber is not supplied to the screw chamber 27. Thus, it is possible to reduce the amount of lubricating oil supplied to the screw chamber 27. Accordingly, it is possible to suppress cooling of the gas to be compressed in the screw chamber 27 and increase the temperature of the gas to be compressed at the discharge side of the compressor, which makes it possible to suppress condensation of the gas to be compressed and the amount of dissolution of the gas to be compressed in the lubricating oil.

Furthermore, the lubricating oil supplied to the bearing chambers does not make contact with the gas to be compressed having a high discharge pressure, and thus it is possible to reduce the size of the oil cooler 58 for cooling lubricating oil to be supplied to the bearing chamber.

Still further, slight leakage of lubricating oil between the screw chamber 27 and the bearing chambers is allowable, and thus it no longer necessary to provide a costly seal structure as described in Patent Document 1. Thus, it is possible to reduce the size and costs of the seal structure.

Further, while the first branch discharge flow passage 60 is formed in communication with the first discharge flow passage 52 and the screw chamber 27, the above described typical oil-flooded screw compressor has a passage similar to the first branch discharge flow passage 60, formed through the housing wall. Such a typical oil-flooded screw compressor can be modified into the screw compressor 11, by simply closing the first branch discharge flow passage 60 with the closure plug 62, and forming the flow passage 52*a* with an opening on the outer surface of the housing wall communicating with the first discharge flow passage 52.

Further, when the amount of lubricating oil inside the lubricating oil reservoir 46 decreases, it is possible to recover the lubricating oil r inside the gas-liquid separator 36 automatically to the lubricating oil reservoir 46 by opening the open-close valve 72 with the controller 76, due to the pressure difference between the lubricating oil reservoir 46 and the gas-liquid separator 36. Accordingly, it is possible to ensure the amount of lubricating oil in the lubricating oil reservoir 46 constantly.

While the lubricating oil stored in the gas-liquid separator contains gas to be compressed, the gas to be compressed is separated from the lubricating oil when the lubricating oil enters the lubricating oil reservoir 46 having a low pressure, and is discharged through the inlet port 64 of the screw compressor 11 via the suction branch path 68 and the suction path 66. Thus, the amount of gas to be compressed in the lubricating oil stored in the lubricating oil reservoir 46 decreases.

Further, the controller 76 adjusts the opening degree of the flow-rate adjustment valve 78 in accordance with the detection value of the temperature sensor 43, and thus it is possible to adjust the temperature of the discharge gas to a desired temperature. Accordingly, it is possible to increase the temperature of the gas to be compressed, which makes it possible to suppress condensation of the gas to be compressed and the amount of dissolution of the gas to be compressed in the lubricating oil.

Further, the gas to be compressed does not enter the second lubricating oil supply system 20 except for the minute amount of gas to be compressed that leaks from the screw chamber 27 to the suction-side bearing chambers 28*a*, 28*b* and the discharge-side bearing chambers 29*a*, 29*b*. Thus, even in a case where the gas to be compressed is a gas that is highly compatible with the lubricating oil, such as a hydrocarbon gas, particularly a hydrocarbon gas having a molar mass of at least 44 (e.g. a hydrocarbon gas having a greater molar mass than propane gas), it is possible to suppress a decrease in the viscosity of lubricating oil supplied to the bearing chamber, and to suppress damage to the bearing portions 16*a* and 16*b*.

Next, with reference to FIGS. 5 to 8, an embodiment of a method for modifying a typical oil-flooded screw compressor system to obtain the second oil-flooded screw compressor system according to the present invention will be described.

Figure 5:
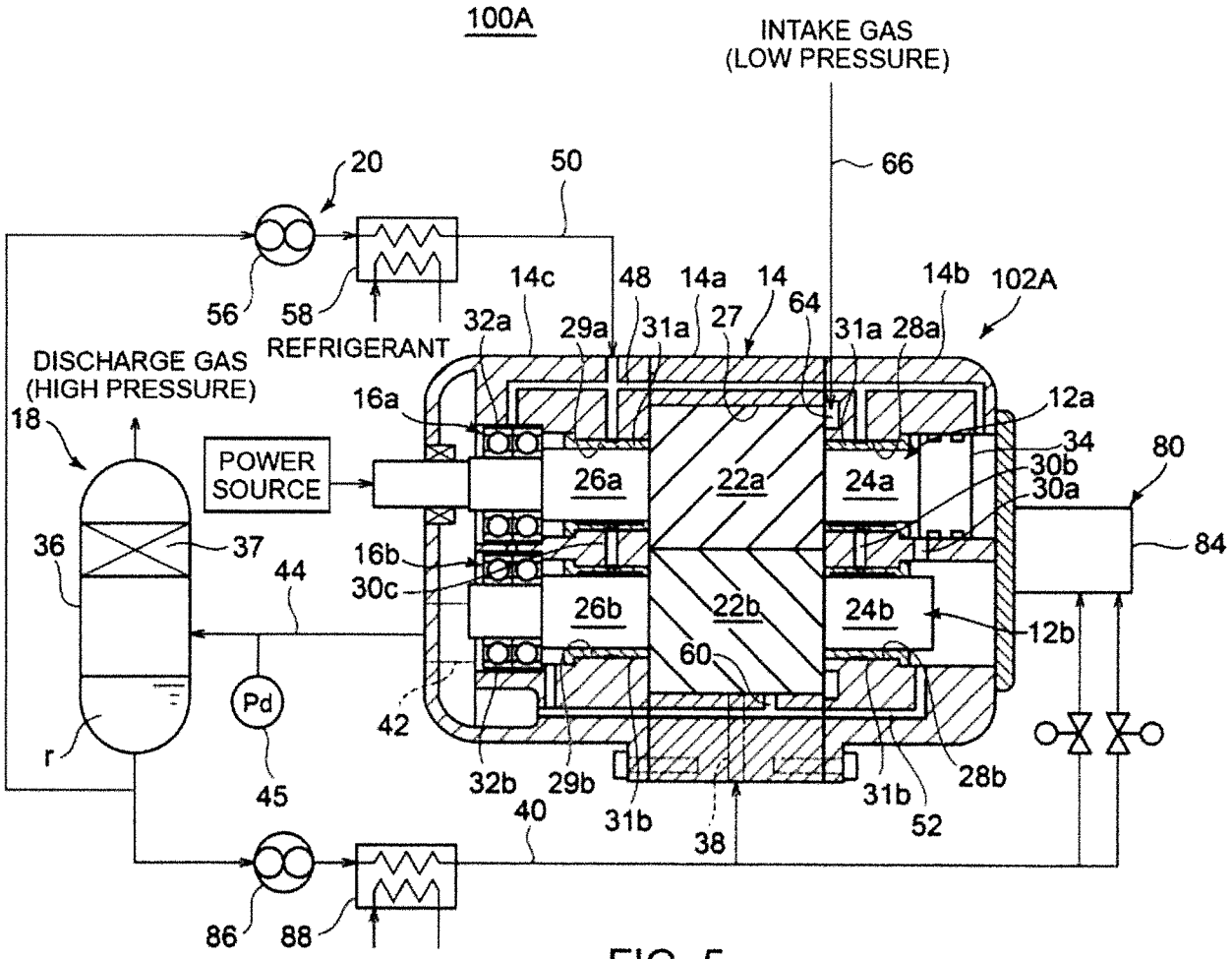
FIG. 5 (RELATED ART)
FIG. 5 is a system diagram of a typical oil-flooded screw compressor system.

FIG. 5 is a diagram of a typical oil-flooded screw compressor system 100A. The oil-flooded screw compressor system 100A includes a screw compressor 102A.

The screw compressor 102A includes a lubricating oil flow passage (second discharge flow passage) including the first discharge flow passage 52 and the first branch discharge flow passage 60 and being in communication with the suction-side bearing chambers 28*b* and the discharge-side bearing chamber 29*b* and the screw chamber 27. Such a compressor housing that includes the above lubricating oil passages is made by casting, for instance.

The oil-flooded screw compressor system 100A includes the second supply path 50 which does not have the lubricating oil reservoir 46. The second supply path 50 is connected to the first supply path 40 in the vicinity of the gas-liquid separator 36, and supplies lubricating oil r of the gas-liquid separator 36 to the second supply flow passage 48. Further, the screw compressor 102A includes the first branch discharge flow passage 60 and the first discharge flow passage 52, and the lubricating oil flow passage (second discharge flow passage) is in communication with the suction-side bearing chambers 28*b* and the discharge-side bearing chamber 29*b* and the screw chamber 27.

The rest of the configuration is the same as that of the oil-flooded screw compressor system 10, and the same features are associated with the same reference numerals.

In the oil-flooded screw compressor system 100A, lubricating oil discharged from the suction-side bearing chamber 28*b* and the discharge-side bearing chamber 29*b* is supplied to the screw chamber 27 through the first discharge flow passage 52 and the first branch discharge flow passage 60. The lubricating oil lubricates the screw parts 22*a* and 22*b*, and returns with the discharge gas to the gas-liquid separator 36 through the discharge path 42 and the discharge gas path 44. The lubricating oil r is separated from the discharge gas in the gas-liquid separator 36, and then is supplied to the second supply flow passage 48 via the second supply path 50.

Figure 6:
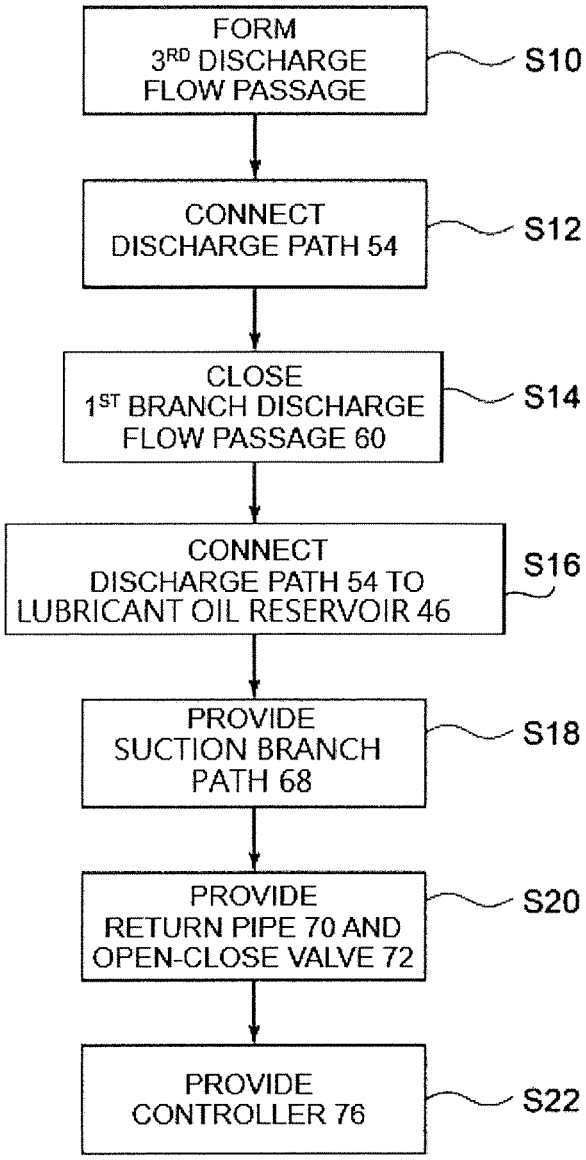
FIG. 6 is a flowchart of a modifying method according to an embodiment.

The oil-flooded screw compressor system 100A is modified into the oil-flooded screw compressor system 10 by the modification process shown in FIG. 6.

In FIG. 6, a flow passage 52*a* (third discharge flow passage) is formed through a housing wall (screw casing 14*a*), the flow passage 52*a* communicating with the second discharge flow passage including the first discharge flow passage 52 and the first branch discharge flow passage 60, and having an opening on the outer surface of the screw casing 14*a* and the screw chamber 27 together with the second discharge flow passage (the first step S10). The third discharge flow passage is a linear through hole.

Next, a discharge path 54 is connected to the opening of the third discharge flow passage on the outer surface of the housing (the second step S12). For example, the pipe 90 is fixed as shown in FIG. 4, and the discharge path 54 is connected to the pipe 90 via the coupling 55 to bring the flow passage 52*a* and the discharge path 54 into communication.

Next, as shown in FIG. 3, the first branch discharge flow passage 60 is closed by the closure plug 62 (the third step S14).

Further, the second supply path 50 is connected to the lubricating oil reservoir 46, and the discharge path 54 is connected to the lubricating oil reservoir 46 (the fourth step S16).

In the present embodiment, the following exemplary steps are added. In this case, the lubricating oil reservoir 46 includes a tank that can be sealed tightly.

A suction branch path 68 is provided, which is branched from the suction path 66 connected to the inlet port 64 of the screw compressor 11, and is connected to the lubricating oil reservoir 46 (the eighth step S18). Next, a return pipe 70 is provided, which is connected to the lubricating oil reservoir 46 and to the lubricating oil storage region of the gas-liquid separator 36, and an open-close valve 72 is provided in the return pipe 70 (the ninth step S20). Further, an oil-surface level sensor 74 is provided for the lubricating oil reservoir 46, and a controller 76 is provided, which receives a detection value from the oil-surface level sensor 74 and opens the open-close valve 72 when the detection value becomes at most a threshold (the tenth step S22).

With the above steps, it is possible to modify a typical oil-flooded screw compressor, easily and at low costs, to the oil-flooded screw compressor system 10 including the first lubricating oil supply system 18 for supplying lubricating oil to the screw chamber 27, and the second lubricating oil supply system 20 for supplying lubricating oil to the bearing chambers, independent and separate from the first lubricating oil supply system 18.

Further, with the additional steps S18 to S22, when the oil-surface level of lubricating oil inside the lubricating oil reservoir 46 decreases, it is possible to return the lubricating oil r inside the gas-liquid separator 36 automatically to the lubricating oil reservoir 46 by opening the open-close valve 72, due to the pressure difference between the lubricating oil reservoir 46 and the gas-liquid separator 36. Accordingly, it is possible to ensure the amount of lubricating oil inside the lubricating oil reservoir 46 constantly.

Next, with reference to FIGS. 7 and 8, an embodiment of a method for modifying a typical oil-flooded screw compressor to the third oil-flooded screw compressor according to the present invention will be described.

Figure 7:
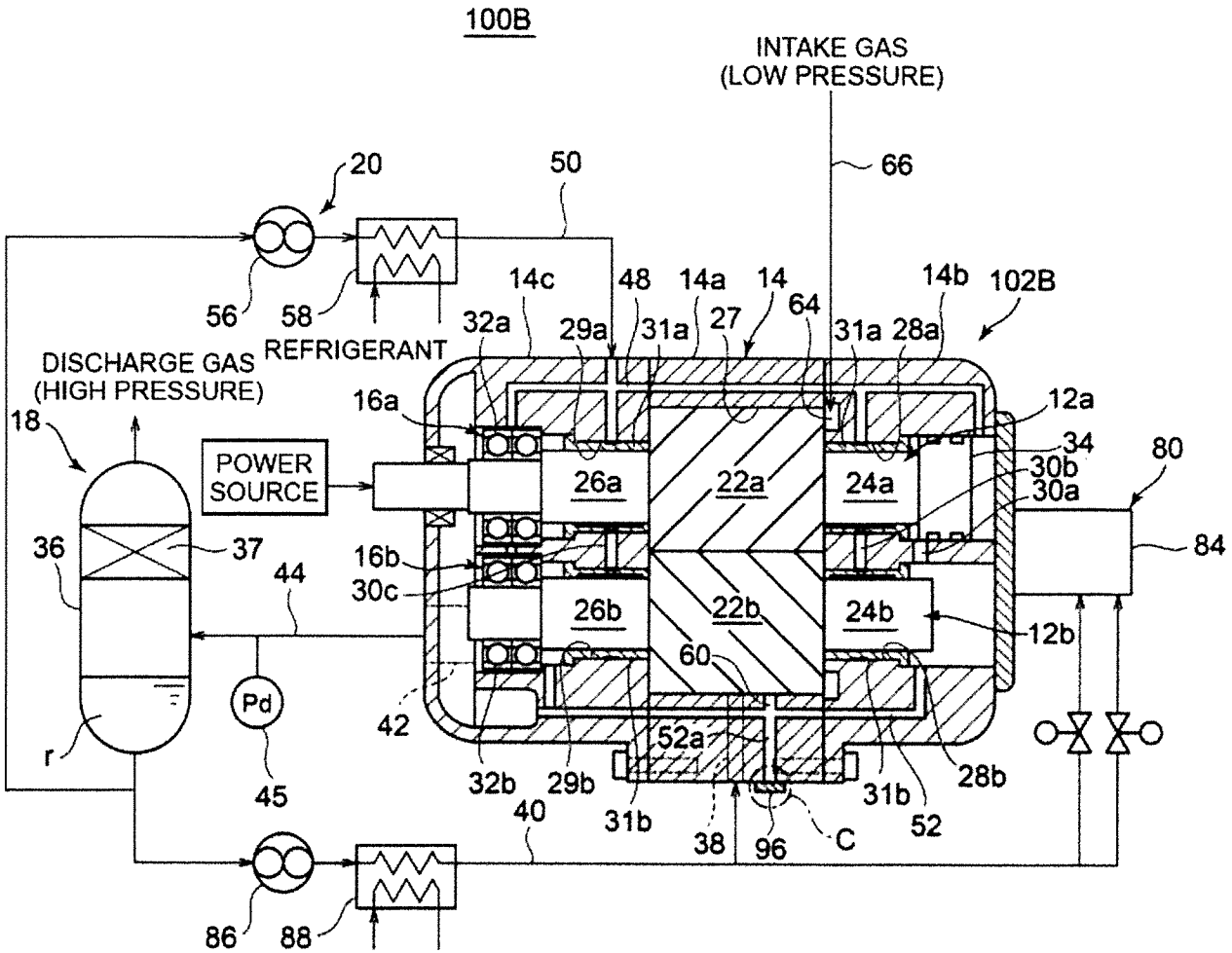
FIG. 7 (RELATED ART)
FIG. 7 is a system diagram of another typical oil-flooded screw compressor system.

FIG. 7 is a diagram of a typical oil-flooded screw compressor system 100B. The oil-flooded screw compressor system 100B includes a screw compressor 102B.

The screw compressor 102B includes the second supply path 50 which does not have the lubricating oil reservoir 46. The second supply path 50 is connected to the first supply path 40 in the vicinity of the gas-liquid separator 36, and supplies lubricating oil r of the gas-liquid separator 36 to the second supply flow passage 48. The screw compressor 102B includes a lubricating oil flow passage (second discharge flow passage) including the first discharge flow passage 52 and the first branch discharge flow passage 60 and being in communication with the suction-side bearing chambers 28*b* and the discharge-side bearing chamber 29*b* and the screw chamber 27. Further, the screw compressor 102B has the flow passage 52*a* (third discharge flow passage) communicating with the first branch discharge flow passage 60 and having an opening on the outer surface of the housing wall of the screw casing 14*a*, and also forming a linear through hole in the axial direction with the first branch discharge flow passage 60.

The rest of the configuration is the same as that of the oil-flooded screw compressor 10, and the same features are associated with the same reference numerals.

In a case where the first branch discharge flow passage 60 is formed by machining, it is necessary to form a hole with a drill from the outer surface of the housing wall. Thus, the screw compressor 100B has the flow passage 52*a* that forms a linear through hole in the axial direction with the first branch discharge flow passage 60. Further, the opening of the flow passage 52*a* on the outer surface of the housing wall is closed.

Figure 8:
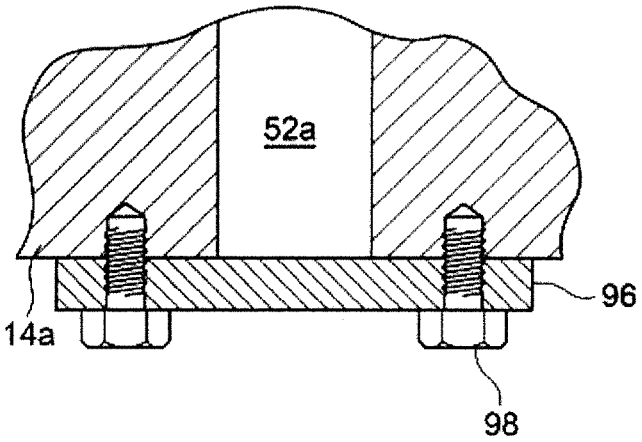
FIG. 8 (RELATED ART)
FIG. 8 is an enlarged cross-sectional view of section C in FIG. 7.

For example, as shown in FIG. 8, the opening of the flow passage 52*a* is closed by a blind flange 96 fixed to the screw casing 14*a* with a plurality of bolts 98.

In the oil-flooded screw compressor system 100B, lubricating oil discharged from the suction-side bearing chamber 28*b* and the discharge-side bearing chamber 29*b* is supplied to the screw chamber 27. The lubricating oil lubricates the screw parts 22*a* and 22*b*, and returns to the gas-liquid separator 36 through the discharge path 42 and the discharge gas path 44 with the discharge gas. The lubricating oil r is separated from the discharge gas in the gas-liquid separator 36, and then is supplied to the second supply flow passage 48 via the second supply path 50.

Similarly to the oil-flooded screw compressor system 100A, the oil-flooded screw compressor system 100B undergoes steps S12 to S16 of the modification process shown in FIG. 6. Further, for example, steps S18 to S22 are added.

With the above steps, it is possible to modify a typical oil-flooded screw compressor, easily and at low costs, to the oil-flooded screw compressor system 10 including the first lubricating oil supply system 18 for supplying lubricating oil to the screw chamber 27, and the second lubricating oil supply system 20 for supplying lubricating oil to the bearing chambers, separate and independent from the first lubricating oil supply system 18.

With the above additional steps S18 to S22, it is possible to achieve the same advantageous effects as the modifying steps according to the above embodiment.

INDUSTRIAL APPLICABILITY

According to at least one embodiment of the present invention, it is possible to provide an oil-flooded screw compressor system whereby it is possible to suppress dissolution of gas to be compressed in lubricating oil and to suppress damage to bearings disposed in bearing chambers, even in a case where the gas to be compressed is compatible with the lubricating oil, which can be provided by making a simple modification to a typical oil-flooded screw compressor system.

The invention claimed is:

1. An oil-flooded screw compressor system for compressing a gas to be compressed which is a compatible gas with lubricating oil, comprising:

a screw compressor which includes:

a male screw rotor and a female screw rotor each having a screw part and shaft portions formed on both ends of the screw part;

a housing having a screw chamber accommodating the screw parts inside and a bearing chamber accommodating the shaft portions inside; and a bearing disposed in the bearing chamber, for rotatably supporting the shaft portions;

a first lubricating oil supply system for supplying lubricating oil to the screw parts; and a second lubricating oil supply system for supplying the lubricating oil to the bearing, wherein the first lubricating oil supply system includes:

a gas-liquid separator configured to introduce discharge gas of the screw compressor therein and to separate the lubricating oil from the discharge gas;

a first supply flow passage formed through a housing wall which constitutes the housing, the first supply flow passage having an opening on an outer surface of the housing wall and being in communication with the screw chamber; and a first supply path connected to a lubricating-oil storage region of the gas-liquid separator and to the opening of the first supply flow passage, and wherein the second lubricating oil supply system includes:

a lubricating oil reservoir;

a second supply flow passage formed through the housing wall, the second supply flow passage having an opening on the outer surface of the housing wall and being in communication with the bearing chamber;

a second supply path connected to the lubricating oil reservoir and to the opening of the second supply flow passage;

a first discharge flow passage formed through the housing wall, the first discharge flow passage being in communication with the bearing chamber and having an opening on the outer surface of the housing wall; and a discharge path connected to the lubricating oil reservoir and to the opening of the first discharge flow passage, wherein a first branch discharge flow passage is formed so as to communicate with the first discharge flow passage and the screw chamber, wherein the first branch discharge flow passage and a part of the first discharge flow passage having an opening on the outer surface of the housing wall together constitute a linear through hole, and wherein the first branch discharge flow passage of the linear through hole is closed by a first closure member.

2. The oil-flooded screw compressor system according to claim 1, wherein a tapered female threaded hole is formed on a side of the opening of the first branch discharge flow passage which faces the first discharge flow passage, and wherein the first closure member has a tapered male thread formed thereon, the tapered male thread being engageable with the tapered female threaded hole.

3. The oil-flooded screw compressor system according to claim 1, wherein the lubricating oil reservoir is a sealed tank, and wherein the oil-flooded screw compressor system further comprises:

a suction path connected to an inlet port of the screw compressor;

a suction branch path branched from the suction path and connected to the lubricating oil reservoir;

a return pipe connected to the lubricating oil reservoir and to a lubricating oil storage region of the gas-liquid separator;

an open-close valve disposed in the return pipe;

an oil-surface level sensor provided for the lubricating oil reservoir; and a controller which is configured to receive a detection value from the oil-surface level sensor and to open the open-close valve when the detection value is at most a threshold.

4. The oil-flooded screw compressor system according to claim 3, further comprising:

a discharge gas path disposed in the housing;

a temperature sensor for detecting a temperature of the discharge gas flowing through the discharge gas path; and a flow-rate adjustment valve disposed in the first supply path, wherein the controller is configured to receive a detection value of the temperature sensor and to adjust an opening degree of the flow-rate adjustment valve to adjust the temperature of the discharge gas.

5. The oil-flooded screw compressor system according to claim 1, wherein the gas to be compressed is a hydrocarbon gas.

6. The oil-flooded screw compressor system according to claim 5, wherein the gas to be compressed is a hydrocarbon gas having a molar mass of at least 44.

7. An oil-flooded screw compressor, comprising:

a male screw rotor and a female screw rotor each having a screw part and shaft portions formed on both ends of the screw part;

a housing having a screw chamber accommodating the screw parts inside and a bearing chamber accommodating the shaft portions inside;

a first supply flow passage formed through a housing wall which constitutes the housing so as to be in communication with the screw chamber and configured to supply a first oil to the screw chamber;

a second supply flow passage formed through the housing wall so as to be in communication with the bearing chamber and configured to supply a second oil to the bearing chamber;

a discharge flow passage formed through the housing wall so as to be in communication with the bearing chamber and configured to discharge the second oil from the bearing chamber; and a closure member disposed in a through hole penetrating the housing wall to radially extend to the screw chamber, wherein the discharge flow passage includes:

a radial passage formed by a portion of the through hole positioned opposite to the screw chamber across the closure member; and an axial passage axially extending in the housing wall to intersect with the radial passage so as to be communicated with the bearing chamber and the radial passage.

8. A method of modifying an oil-flooded screw compressor which comprises: a male screw rotor and a female screw rotor each having a screw part and shaft portions formed on both ends of the screw part; a housing having a housing wall to form a screw chamber accommodating the screw parts inside and a bearing chamber accommodating the shaft portions inside; and an axial passage axially extending in the housing wall to be communicated with the bearing chamber, the method comprising:

forming a through hole which penetrates the housing wall to radially extend to the screw chamber such that the through hole intersects with the axial passage at an intersection; and disposing a closure member in the through hole at a position between the screw chamber and the intersection such that a radial passage formed by a portion of the through hole positioned opposite to the screw chamber across the closure member constitutes a discharge flow passage for discharging oil from the bearing chamber together with the axial passage.

9. The method of modifying an oil-flooded screw compressor system according to claim 8, connecting the discharge flow passage to a lubricating oil reservoir for storing the oil to be supplied to the bearing chamber via a flow path.

10. The method of modifying an oil-flooded screw compressor system according to claim 9, wherein the lubricating oil reservoir is a tank inside of which is sealable, wherein the method further comprises:

providing a suction branch path which branches from a suction path connected to an inlet port of the screw compressor and connects to the lubricating oil reservoir;

providing a return pipe to be connected to the lubricating oil reservoir and to a lubricating-oil storage region of a gas-liquid separator configured to introduce discharge gas of the screw compressor therein and to separate the lubricating oil from the discharge gas, and providing an open-close valve for the return pipe; and providing an oil-surface level sensor disposed in the lubricating oil reservoir, and a controller for receiving a detection value of the oil-surface level sensor and opening the open-close valve when the detection value becomes at most a threshold.

* * * * *